US006675999B2

(12) United States Patent
Mukoyama et al.

(10) Patent No.: US 6,675,999 B2
(45) Date of Patent: Jan. 13, 2004

(54) FASTENER DRIVING TOOLS HAVING IMPROVED DRIVE MODE CHANGE DEVICES

(75) Inventors: Kenji Mukoyama, Anjo (JP); Nobuyuki Kakuda, Anjo (JP)

(73) Assignee: Makita Corporation, Anjo (JP)

( * ) Notice: Subject to any disclaimer, the term of this patent is extended or adjusted under 35 U.S.C. 154(b) by 34 days.

(21) Appl. No.: 09/742,187

(22) Filed: Dec. 22, 2000

(65) Prior Publication Data

US 2001/0006183 A1 Jul. 5, 2001

(30) Foreign Application Priority Data

Dec. 24, 1999 (JP) ..... 11-367864
Dec. 24, 1999 (JP) ..... 11-367865

(51) Int. Cl.[7] ..... B21J 15/28; B25C 1/04
(52) U.S. Cl. ..... 227/8; 227/130
(58) Field of Search ..... 227/8, 130, 142, 227/2, 121, 129; 173/170

(56) References Cited

U.S. PATENT DOCUMENTS 3,774,293 A * 11/1973 Golsch ..... 227/130
3,784,077 A * 1/1974 Burke et al. ..... 227/8
4,264,028 A * 4/1981 Austin ..... 227/8
4,351,464 A * 9/1982 Fehrs et al. ..... 227/132
4,679,719 A * 7/1987 Kramer ..... 227/5
5,035,354 A * 7/1991 Meyer ..... 227/7
5,137,197 A * 8/1992 Bauer ..... 227/8
5,522,532 A * 6/1996 Chen ..... 227/130
5,692,663 A * 12/1997 Yang ..... 227/8
5,785,227 A * 7/1998 Akiba ..... 227/142
5,785,228 A * 7/1998 Fa et al. ..... 227/130
5,791,545 A * 8/1998 Lin ..... 227/8
5,896,933 A * 4/1999 White ..... 227/130
6,059,161 A * 5/2000 Chang et al. ..... 227/8
6,116,488 A * 9/2000 Lee ..... 227/130
6,371,348 B1 * 4/2002 Canlas et al. ..... 227/8
6,431,425 B1 * 8/2002 Moorman et al. ..... 227/8

FOREIGN PATENT DOCUMENTS

JP 8-90449 4/1996
JP 2568721 1/1998
JP 10264052 10/1998

* cited by examiner

*Primary Examiner*—Rinaldi I. Rada
*Assistant Examiner*—Paul R Durand
(74) *Attorney, Agent, or Firm*—Dennison, Schultz & Dougherty

(57) ABSTRACT

A fastener driving tool includes a fastener drive mechanism and a trigger that is movable from an OFF position to an ON position for actuating the fastener drive mechanism. A mode change device is operable to selectively change a tool mode among a first drive mode, a second drive mode and a drive inhibit mode for the fastener drive mechanism. The mode change device includes an operation member that is operable by an operator. The operation member has a plurality of operational positions that correspond to the changeable modes.

34 Claims, 7 Drawing Sheets

FASTENER DRIVING TOOLS HAVING IMPROVED DRIVE MODE CHANGE DEVICES

BACKGROUND OF THE INVENTION

1. Field of the Invention

The present invention relates to fastener driving tools such as pneumatic nail guns, power screwdrivers and staplers, and in particular to fastener driving tools having drive mode change devices.

2. Description of the Related Art

Known pneumatic nail guns have a drive mechanism that is disposed within a body and is driven by a compressed air. The drive mechanism is connected to a driver and is actuated by the operation of a trigger, so that the driver can reciprocally move to drive nails one after another out of a driver guide that extends from the body.

In order to prevent the nails from being accidentally driven, a contact arm is mounted on the body so as to extend downward from the lower end of the driver guide. When the contact arm has pressed against a workpiece, the contact arm slides upward relative to the driver guide to permit the trigger to actuate the drive mechanism. Thus, the driving operation of the nails can be performed only when the contact arm has moved upward.

Japanese Laid-Open Patent Publication No. 10-264052 teaches a pneumatic nail gun that includes a drive mode change device, so that the nail gun can operate in a first drive mode and a second drive mode. In the first drive mode, the drive mechanism can be actuated according to either a first sequence, in which the trigger is operated after the contact arm has moved upward, or a second sequence, in which the contact arm is moved upward after the trigger has been operated. In the second drive mode, the drive mechanism can be actuated according to only the first sequence. Therefore, a nail-on-nail driving operation can be reliably prevented.

The nail gun of this publication also includes a trigger lock mechanism that can prevent the nails from being accidentally driven during transportation or like occasions. Thus, the trigger lock mechanism can prevent a trigger from moving from an OFF position to an ON position, so that a nail drive mechanism will not be actuated even if a contact arm has been accidentally moved by contacting the other parts or objects during the transportation. Thus, the trigger lock mechanism serves to provide a drive inhibit mode.

However, the drive mode change device and the trigger lock mechanism are operated by different operation members from each other. Therefore, the operation for changing the drive mode between the first or second drive mode and the drive inhibit mode is very troublesome.

SUMMARY OF THE INVENTION

It is, accordingly, one object of the present invention to teach improved fastener driving tools. Preferably, such fastener driving tools can simplify the operation for changing the drive mode.

In one aspect of the present teachings, fastener driving tools may have a mode change device, which device enables a first drive mode, a second drive mode and a drive inhibit mode for a fastener drive mechanism. Preferably, the mode change device includes an operation member that is operable by an operator. The operation member may have a plurality of operational positions that correspond to the changeable modes. Preferably, the operation member is a single member.

Therefore, the operator is not required to operate different mode change devices in response to a change in the mode. In addition, the fastener driving tool may have a simple construction.

In a representative embodiment, the drive inhibit mode can be realized, for example, by preventing the trigger from moving from an OFF position to an ON position. Thus, this mode may provide a trigger lock function.

In the first drive mode, the fastener drive mechanism may be actuated when the trigger and a control member, which may be a contact arm, have been moved for actuating the fastener drive mechanism in either a first sequence or a second sequence. According to the first sequence, the trigger is moved from an OFF position to an ON position after the control member has moved from the second position to the first position. According to the second sequence, the trigger is moved from the first position to the second position after the trigger has moved from the OFF position to the ON position.

In the second drive mode, the fastener drive mechanism can be actuated only when the trigger and the control member are moved according to the first sequence.

In a preferred example, the operation member of the mode change device may be a support shaft that pivotally supports the trigger. Preferably, the support shaft may be rotatably supported by a tool body and may have a shaft portion, on which the trigger is pivotally supported. The support shaft may rotate relative to the body about a first axis, and the shaft portion may have a second axis that is displaced from the first axis. Therefore, the position of the first axis may change as the support shaft rotates, so that the path of the pivotal movement of the trigger changes in response to the rotational position of the support shaft. As a result, the operational relationship between the trigger and the control member or other parts of the tool that cooperate with the trigger may change, so that the different drive modes can be attained. This arrangement is advantageous, because the operation member serves as a support for the trigger and also serves as a part of the mode change device. Thus, a lock pin or like members for exclusively providing a trigger lock function as in the known tools are not required. Therefore, the construction of the tool about the trigger may be simplified.

In order to change the mode, the mode change device may change the position of a contact arm or an idler that may be mounted on the trigger. Thus, the mode can be changed by changing the positional relationship among the trigger and the other parts that cooperate with the trigger for actuating the fastener drive mechanism.

Other objects, features and advantages of the present invention will be readily understood after reading the following detailed description together with the accompanying drawings and the claims.

DETAILED DESCRIPTION OF THE INVENTION

Figure 1:
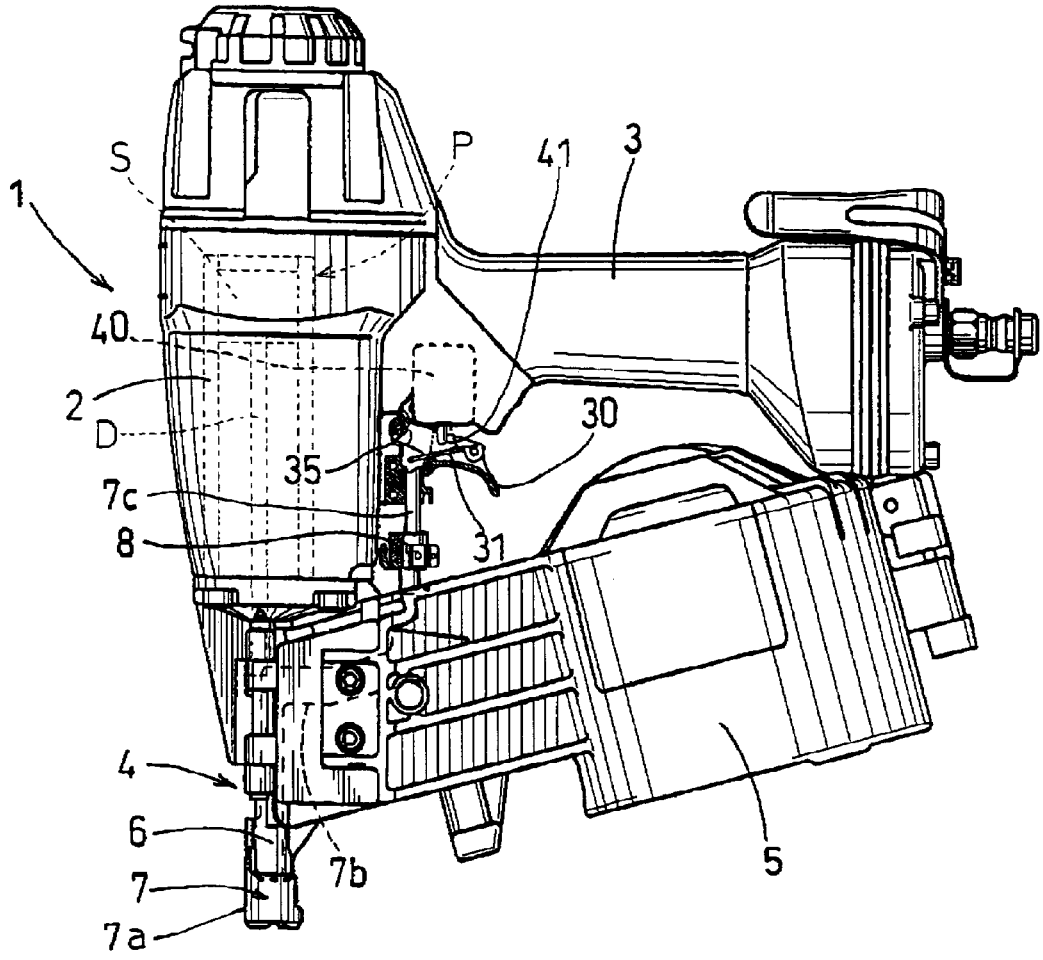
FIG. 1 is a right side view of a representative pneumatic nail gun having an improved mode change device.

Fastener driving tools may include a tool body and a fastener drive mechanism may be disposed within the tool body. A trigger may move from an OFF position to an ON position for actuating the fastener drive mechanism. A mode change device may operate to selectively change a tool mode among a first drive mode, a second drive mode and a drive inhibit mode for the fastener drive 3mechanism. The mode change device may include an operation member that is operable by an operator. The operation member may have a plurality of operational positions that correspond to the changeable drive modes. As a result, the tool can be changed to any one of the first drive mode, the second drive mode and the drive inhibit mode by operating the operation member. Therefore, the mode change operation can be easily and rapidly performed.

In a representative embodiment, the trigger cooperates with a contact arm for actuation of the fastener drive mechanism The contact arm may move between a first position and a second position. Preferably, the contact arm may be moved from the first position to the second position when the contact arm is pressed against a workpiece.

Preferably, the first drive mode may enable the actuation of the fastener drive mechanism when the trigger and the contact arm are moved in either a first sequence or a second sequence. According to the first sequence, the trigger is moved from the OFF position to the ON position after the contact arm has moved from the second position to the first position. According to the second sequence, the contact arm is moved from the first position to the second position after the trigger has moved from the OFF position to the ON position.

The second drive mode may enable the actuation of the fastener drive mechanism only when the trigger and the control member are moved in the first sequence.

In a representative embodiment, the trigger may pivot about a first axis between the ON position and the OFF position. The mode change device may be operable to change the position of the first axis in response to change in the tool mode and may include a support shaft that is rotatably supported by a tool body about a second axis. The support shaft may have a shaft portion that has the first axis. Preferably, the first axis and the second axis are displaced from each other.

Preferably, a stopper may be positioned to oppose to the trigger when the tool is in the drive inhibit mode, so that the trigger is prevented from moving from the OFF position to the ON position. Therefore, a trigger lock function can be attained without a lock pin as in the known tools.

In an alternative embodiment, the mode change device is operable to shift an operation portion of the contact arm in a direction substantially vertically relative to the moving direction of the operation portion when the contact arm moves between the first position and the second position.

In another alternative embodiment, the mode change device is operable to shift a pivotal axis of an idler that cooperates with the trigger or is operable to change the position of one end of the idler opposite to the pivotal axis.

Each of the additional features and method steps disclosed above and below may be utilized separately or in conjunction with other features and method steps to provide improved fastener driving tools and methods for designing and using such fastener driving tools. Representative examples of the present invention, which examples utilize many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples may be combined in ways that are not specifically enumerated in order to provide additional useful embodiments of the present teachings.

A representative embodiment of a fastener driving tool will now be described with reference to FIGS. 1 to 15.

FIG. 1 illustrates a side view of a representative pneumatic nail gun 1, which nail gun may generally comprise a body 2 and a handle 3 that extends rearward from the body 2. A nose 4 may be disposed at the lower end of the body 2 and may include a driver guide 6. A driver D may have a lower end that reciprocally moves within the driver guide 6 so as to drive the nails out of the lower open end of the driver guide 6.

A magazine 5 may store a plurality of nails that are joined in series with each other. The magazine 5 may be connected between the nose 4 and the rear end of the handle 3 and may include a nail feeding mechanism (not shown) for feeding the nails one after another into the driver guide 6.

A pneumatic drive mechanism P may be disposed within the body 2 and may include a piston S that can reciprocally move within the body 2. The piston S may be connected to the driver D.

Figure 4:
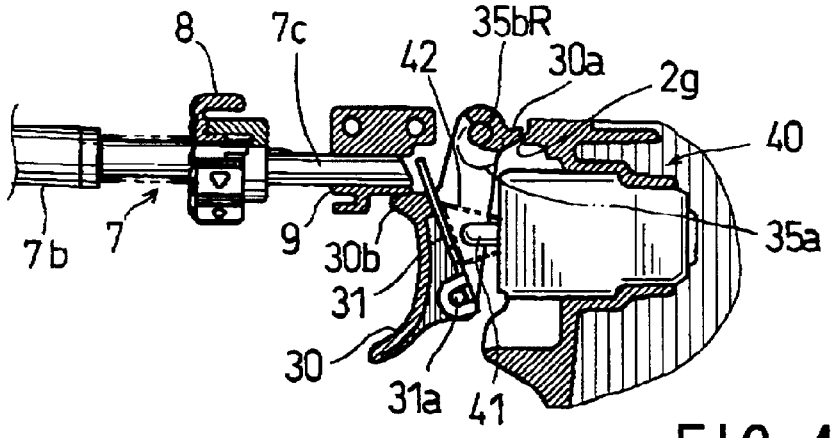
FIG. 4 is a sectional view illustrating the operation of the trigger and a contact arm when the mode change device is set to an unlimited drive mode, while the contact arm is in a lowermost position and the trigger is in an OFF position.

A contact arm 7 may be mounted on the driver guide 6, so that the contact arm 7 can vertically slide along the driver guide 6. The contact arm 7 may include a contact portion 7*a*, and extension 7*b* and an operation portion 7*c*. The extension 7*b* may extend upward from the contact portion 7*a* along the driver guide 6. The operation portion 7*c* may be connected to the upper end of the extension 7*b*. As shown in FIG. 4, an upper part (right side part as viewed in FIG. 4) of the operation portion 7*c* may be vertically (horizontally as viewed in FIG. 4) and slidably supported by a support bracket 9 that is mounted on the body 2, so that the upper end of the operation portion 7*c* may extend adjacent to a trigger valve 40. As shown in FIG. 1, the trigger valve 40 may be disposed on the rear side of the body 2 in the vicinity of the handle 3.

A driving depth adjusting device 8 may be interposed between the operation portion 7*c* and the extension 7*b* and may be operable to change the position of the operation portion 7*c* relative to the extension 7*b*, so that the driving depth of nails into workpieces (not shown) can be changed.

A compression spring (not shown) may downwardly bias the contact arm 7, so that the contact arm 7 can be normally held in a lowermost position, in which the lower end of the contact portion 7*a* extends downward from the lower end of the driver guide 6 as shown in FIG. 1. Therefore, the contact arm 7 can move upward from the lowermost position by a distance that corresponds to the extending distance of the contact portion 7*a* from the lower end of the driver guide 6.

When the contact portion 7*a* of the contact arm 7 is pressed against a workpiece (not shown) by downwardly pressing the nail gun 1 against the workpiece, the contact arm 7*a* may move upward against the biasing force of the spring, so that the operation portion 7*c* moves from an inoperative position to an operative position toward the trigger valve 40. However, in this representative embodiment, the trigger valve 40 may not open even if the operation portion 7*c* has moved to the operative position. In order to open the trigger valve 40, an operator pulls a trigger 30 so as to move the trigger 30 from an OFF position to an ON position.

Figure 2:
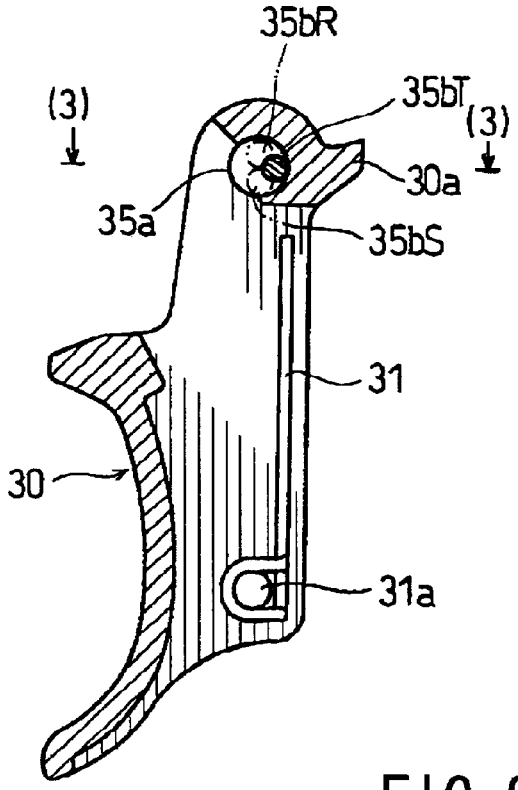
FIG. 2 is a sectional view of a trigger and the mode change device of the representative nail gun.
Figure 3:
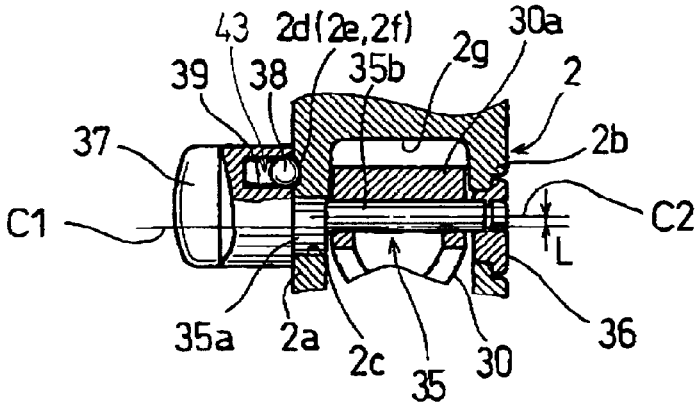
FIG. 3 is a sectional view taken along line (3)—(3) in FIG. 2.

As shown in FIGS. 2 and 3, the trigger 30 may be vertically pivotally mounted on a support shaft 35. The support shaft 35 may be supported between a pair of bifurcated support walls 2*a* and 2*b* that are formed integrally with the body 2 adjacent to the trigger valve 40. As shown in FIG. 3, the support shaft 35 may have a short large-diameter portion 35*a* and a long small-diameter portion 35*b*. Preferably, a central axis C1 of the large-diameter portion 35*a* may be displaced by a distance L from a central axis C2 of the small-diameter portion 35*b*.

The support shaft 35 may be rotatably supported between the support walls 2*a* and 2*b*. More specifically, the large-diameter portion 35*a* may be rotatably received within a support hole 2*c* formed in the support wall 2*a*. One end of the small-diameter portion 35*b* opposite to the large-diameter portion 35*a* may be supported by a support cap 36, such that the small-diameter portion 35*b* can rotate relative to the support cap 36 but cannot move in the axial direction. The support cap 36 also may be rotatably mounted on the support wall 2*b*.

The trigger 30 may be rotatably supported by the small-diameter portion 35*b*, so that the trigger 30 can pivot about the central axis C2.

A knob 37 may be formed integrally with one end of the large-diameter portion 35*a* opposite to the small-diameter portion 35*b* and may be rotated by an operator. A ball 38, preferably made of steel, may be disposed within a ball receiving hole 43 that is defined within the knob 37 at a position opposite to the outer surface of the wall portion 2*a*. A compression spring 39 may also be disposed within the ball receiving hole 43 and may serve to bias the ball 38 toward the wall portion 2*a*. First to third hemispherical recesses 2*d*, 2*e* and 2*f* may be defined within the outer surface of the wall portion 2*a* and may be positioned on a circle about the central axis C1, which circle has a radius that is equal to the distance between the ball 38 and the central axis C1. Preferably, the first to third recesses 2*d*, 2*e* and 2*f* are displaced from each other by an angle of 90°. Therefore, as the knob 37 rotates, the ball 38 can engage any one of the first to third recesses 2*d*, 2*e* and 2*f*. As a result, the rotational position of the support shaft 35 can be held in three different positions about the central axis C1.

As the support shaft 35 rotates, the small-diameter portion 35*b* may rotate about its own axis or the central axis C1, while it moves along a circle having a radius that is equal to the distance L.

When the ball 38 engages the first recess 2*d*, the small-diameter portion 35*b* may be positioned in an uppermost position 35*b*R as viewed in FIG. 2 (leftmost position as viewed in FIG. 1) above the central axis C1 of the large-diameter portion 35*a*. With the support shaft 35 positioned in this rotational position, the nail gun 1 can operate in an unlimited drive mode.

When the operator rotates the support shaft 35 from the uppermost position 35*b*R by and angle of 180° in a counterclockwise direction as viewed in FIG. 2, the ball 38 may engage the second recess 2*e*, so that the small-diameter portion 35*b* may be positioned in a lowermost position 35*b*S as viewed in FIG. 2 (rightmost position as viewed in FIG. 1) below the central axis C1 of the large-diameter portion 35*a*. With the support shaft 35 positioned in this rotational position, the nail gun can be operated in a limited drive mode.

When the operator further rotates the support shaft 35 from the rightmost position 35*b*S by and angle of 90° in a counterclockwise direction as viewed in FIG. 2, the ball 38 may engage the third recess 2*e*, so that the small-diameter portion 35*b* may be positioned in a intermediate position 35*b*T at the same level as central axis C1 of the large-diameter portion 35*a* and may be displaced rightward as viewed in FIG. 2 (upward as viewed in FIG. 1) from the central axis C1 toward the trigger valve 40. With the support shaft 35 set in this rotational position, an operator cannot perform a nail driving operation. Thus, the nail gun 1 is set to a drive inhibit mode.

As shown in FIG. 2, a stopper protrusion 30*a* may be formed on the upper end (left end as viewed in FIG. 1) of the trigger 30 and may extend rightward (upward as viewed in FIG. 1) from the trigger 30. On the other hand, a stopper wall 2*g* may be formed on a part of the body 2 that opposes to the stopper protrusion 30*a*. Preferably, the stopper wall 2*g* may be formed on a base portion of the bifurcated pair of the wall portions 2*a* and 2*b*.

Figure 14:
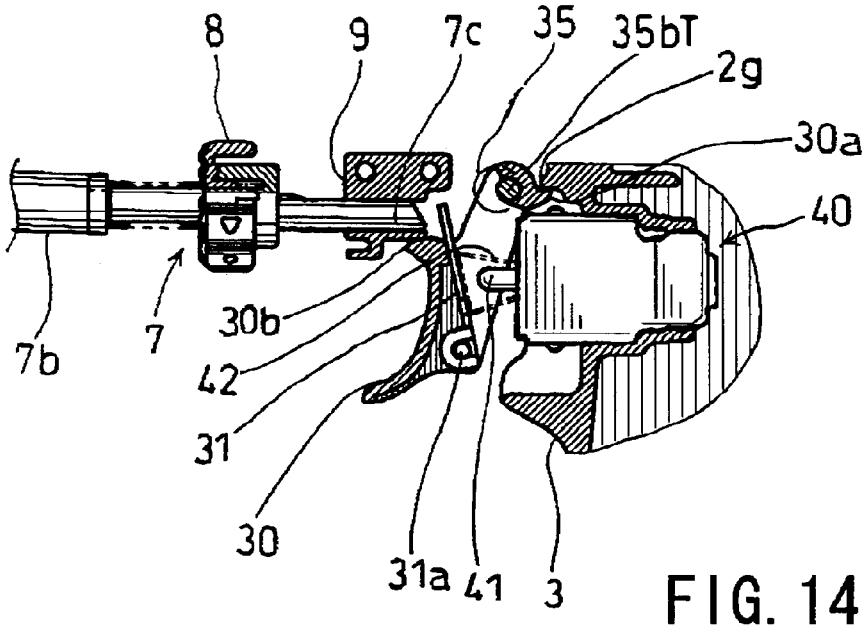
FIG. 14 is a sectional view illustrating the operation of the trigger and a contact arm when the operation mode change device is set to a drive inhibit mode, while the trigger is in the lowermost position and the trigger is in the OFF position.

When the nail gun 1 is set to the drive inhibit mode, the stopper protrusion 30*a* may be positioned adjacent to and below the stopper wall 2*g* as shown in FIG. 14. Therefore, the stopper wall 2*g* may prevent the trigger 30 from moving from the OFF position to the ON position.

Figure 8:
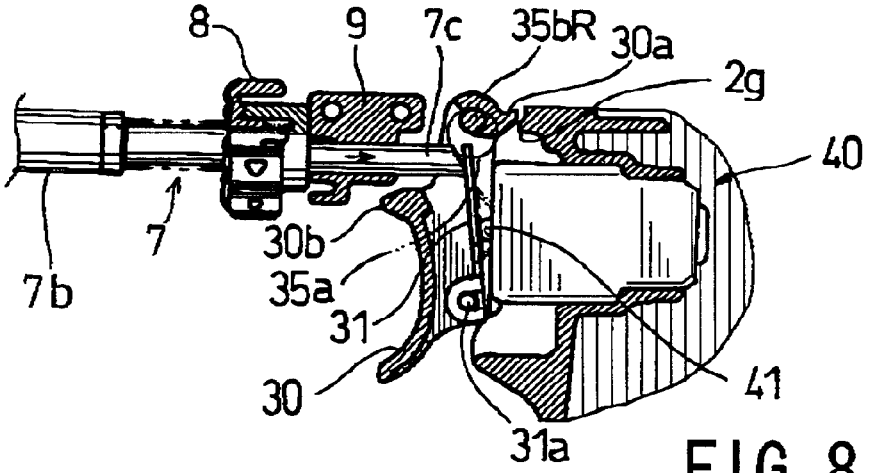
FIG. 8 is a view similar to FIG. 7, but instead, illustrating the operation when the contact arm has raised to the uppermost position.

On the other hand, when the nail gun 1 is set to the unlimited drive mode, the stopper protrusion 30*a* may be positioned above the stopper wall 2*g* as shown in FIG. 4. Therefore, the stopper wall 2*g* may not interfere with the shifting movement of the trigger 30 from the OFF position to the ON position. When the nail gun 1 is set to the limited drive mode, the stopper protrusion 30*a* may be positioned below the stopper wall 2*b* as shown in FIG. 8 but may be displaced leftward (downward as viewed in FIG. 1) from the stopper wall 2*b*. Therefore, also in this mode, the stopper wall 2*g* may not interfere with the shifting movement of the trigger 30 from the OFF position to the ON position.

Thus, in this representative embodiment, various parameters are chosen to enable the above different modes of the nail gun 1 including the unlimited drive mode, the limited drive mode and the drive inhibit mode. Such parameters may include the position of the support shaft 35, the distance L between the central axis C1 of the large diameter portion 35*a* and the central axis C2 of the small-diameter portion 35*b*, and the positions and the configurations of the stopper protrusion 30*a* and the stopper wall 2*g*.

As shown in FIG. 2, an idler 31 may have one end that is pivotally connected to the right and lower side (upper and right side as viewed in FIG. 1) of the trigger 30 by means of a pivot pin 31*a*. The other end of the idler 31 may extend to a position adjacent to the support shaft 35.

As shown in FIG. 1, a trigger valve 40 may be mounted within the body 2 and may be positioned adjacent to the stopper wall 2*g* (see FIG. 4), so that a valve stem 41 of the trigger valve 40 opposes to substantially the central portion of the idler 31. The trigger valve 40 may open when the valve stem 41 has retracted into the body of the trigger valve 40 by a predetermined distance. Then, a compressed air may be supplied to an upper air chamber (not shown) above the piston S of the pneumatic drive mechanism P. As a result, the piston S may move downward with the driver D, so that the nail can be driven out of the driver guide 6.

A compression spring 42 may be interposed between the idler 31 and the trigger valve 40, so that the idler 31 may be biased in a direction away from the valve stem 41. Therefore, the trigger 30 also may be biased by means of the idler 31 in a clockwise direction as viewed in FIG. 4. The trigger 30 may include a stopper portion 30*b* and may normally contact the support bracket 9 by the biasing force of the compression spring 42, so that the trigger 30 can be held in the OFF position against the biasing force. FIGS. 1, 4, 5, 9, 10, 14 and 15 show the trigger 30 in the OFF position.

The operation of the representative nail gun 1, in particular the operation of the trigger valve 40, in the above unlimited drive mode, the limited drive mode and the drive inhibit mode will now be explained in connection with the operation of the contact arm 7 and the trigger 30.

FIG. 4 shows the nail gun 1 in the unlimited drive mode, in which the small-diameter portion 35*b* of the support shaft 35 is in the position 35*b*R above the central axis C1 of the large-diameter portion 35*a*, while the contact arm 7 is in the lowermost position and the trigger 30 is in the OFF position.

Figure 5:
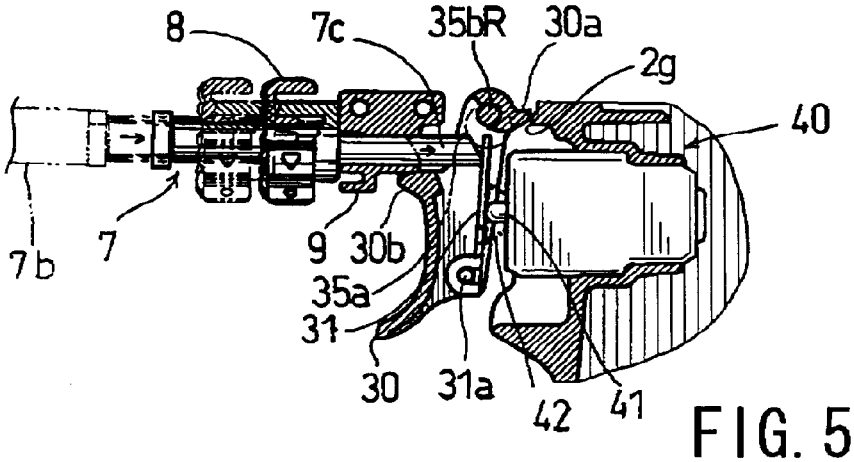
FIG. 5 is a view similar to FIG. 4, but instead, illustrating the operation when the contact arm has raised to an uppermost position.

When the contact arm 7 moves upward (rightward as viewed in FIG. 4), the operation portion 7*c* pushes the upper portion of the idler 31, so that the idler 31 pivots toward the trigger valve 40 against the biasing force of the compression spring 42 as shown in FIG. 5. As a result, the valve stem 41 may retract by a short distance into the valve body of the trigger valve 40. However, this retracting distance is insufficient to open the trigger valve 40. Therefore, the trigger valve 40 will still be held in a closed position.

Figure 6:
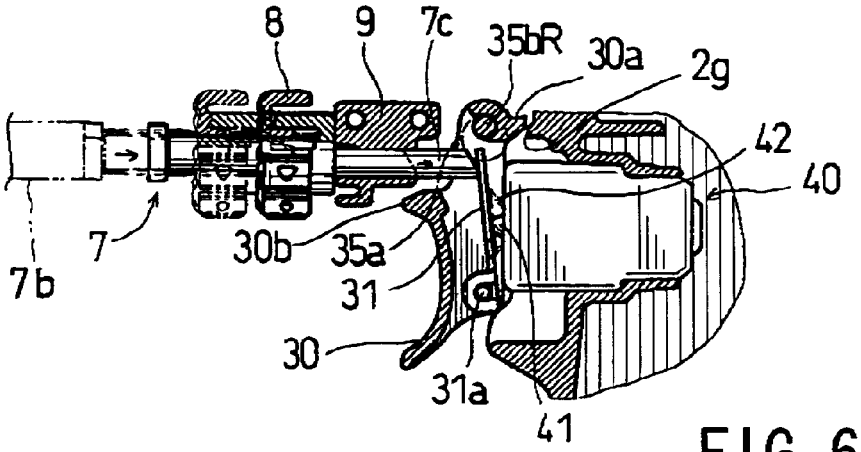
FIG. 6 is a view similar to FIG. 5, but instead, illustrating the operation when the trigger has shifted to an ON position.

Then, the operator pulls the trigger 30 to pivot the trigger 30 in a counterclockwise direction as viewed in FIG. 5, so the trigger 30 moves from the OFF position to the ON position. As a result, the pivot pin 31*a* of the idler 31 may move toward the trigger valve 40, so that the entire idler 31 moves toward the trigger valve 40. Therefore, the valve stem 41 further retracts to open the trigger valve 40 as shown in FIG. 6, so that the nail can be driven into a workpiece (not shown).

Figure 7:
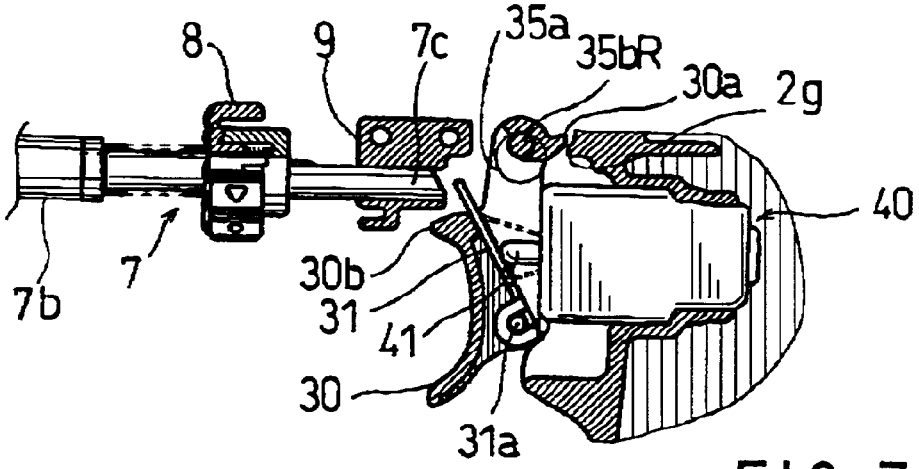
FIG. 7 is a view similar to FIG. 4, but instead, illustrating the operation when the trigger has shifted to an ON position, while the contact arm is held in the lowermost position.

In the state shown in FIG. 4, the stopper protrusion 30*a* of the trigger 30 is positioned above the stopper wall 2*b* of the body 2. Therefore, as shown in FIG. 7, the trigger 30 can be moved from the OFF position to the ON position without interfering with the stopper wall 2*b*, even before the upward movement of the contact arm 7. In this case, the pivot pin 31*a* of the idler 31 may move toward the trigger valve 40. However, this movement of the idler 31 will not cause substantial retraction of the valve stem 41 into the body of the trigger valve 40. Therefore, the trigger valve 40 will not open.

In order to open the trigger valve 40, the contact arm 7 may be moved to the uppermost position, so that the upper portion of the idler 31 may be pushed toward the trigger valve 40 against the biasing force of the compression spring 42 as shown in FIG. 8. As a result, the valve stem 41 may retract by a sufficient amount to open the trigger valve 40.

Therefore, in the unlimited drive mode, the driving operation of the nails can be performed according to either a first sequence, in which the trigger 30 is operated after the upward movement of the contact arm 7, or a second sequence, in which the contact arm 7 is moved upward after the operation of the trigger 30.

Figure 9:
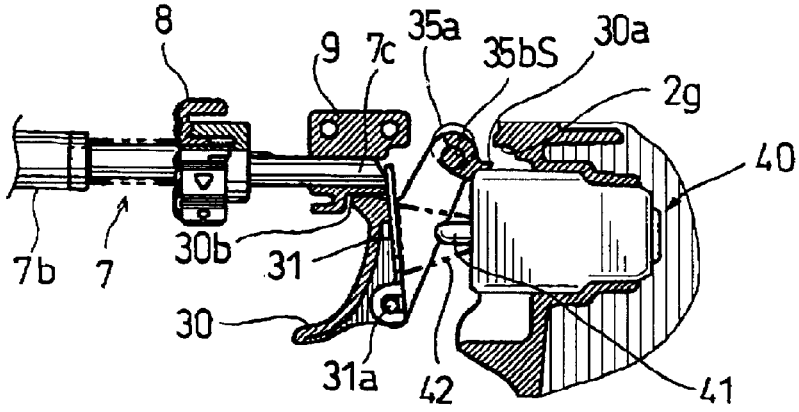
FIG. 9 is a sectional view illustrating the operation of the trigger and a contact arm when the mode change device is set to a limited drive mode, while the trigger is in a lowermost position and the trigger is in an OFF position.

FIG. 9 shows the nail gun 1 in the limited drive mode, in which the small-diameter portion 35*b* of the support shaft 35 is in the position 35*b*S below the central axis C1 of the large-diameter portion 35*a* and is displaced leftward (downward as viewed in FIG. 1) from the stopper wall 2*b*. Thus, in this mode, the pivotal axis of the trigger 30 is disposed at a level lower than that in the unlimited drive mode by a distance of 2L. Therefore, the idler 31 also is disposed at a lever lower than that in the unlimited drive mode by a distance of 2L. Also, in FIG. 9, the contact arm 7 is in the lowermost position and the trigger 30 is in the OFF position.

Figure 10:
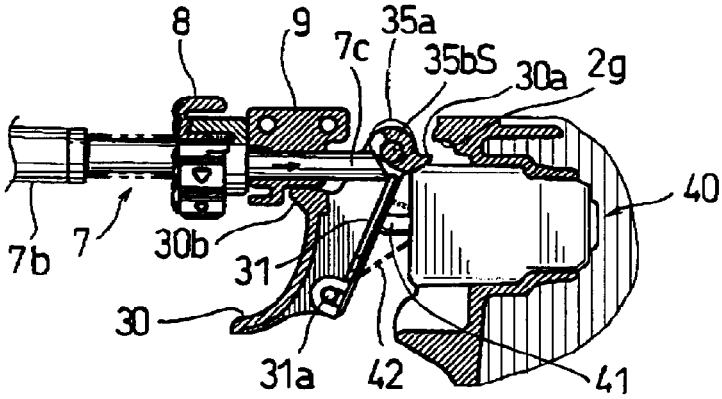
FIG. 10 is a view similar to FIG. 9, but instead, illustrating the operation when the contact arm has raised to the uppermost position.

When the contact arm 7 moves upward (rightward as viewed in FIG. 9), the operation portion 7*c* pushes the upper portion of the idler 31, so that the idler 31 pivots toward the trigger valve 40 against the biasing force of the compression spring 42 as shown in FIG. 10. As a result, the valve stem 41 may retract by a short distance into the body of the trigger valve 40. However, the retracting distance is insufficient to open the trigger valve 40. Therefore, the trigger valve 40 will still be held in the closed position.

Figure 11:
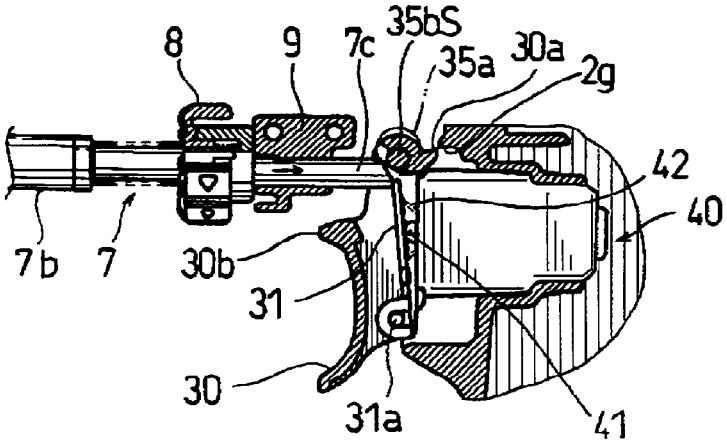
FIG. 11 is a view similar to FIG. 10, but instead, illustrating the operation when the trigger has shifted to the ON position.

Then, the operator pulls the trigger 30 to pivot the trigger 30 in a counterclockwise direction as viewed in FIG. 10, so the trigger 30 moves from the OFF position to the ON position. As a result, the pivot pin 31*a* of the idler 31 may move toward the trigger valve 40, so that the entire idler 31 moves toward the trigger valve 40. Therefore, the valve stem 41 further retracts to open the trigger valve 40 as shown in FIG. 11. As a result, the nail can be driven into a workpiece.

Figure 12:
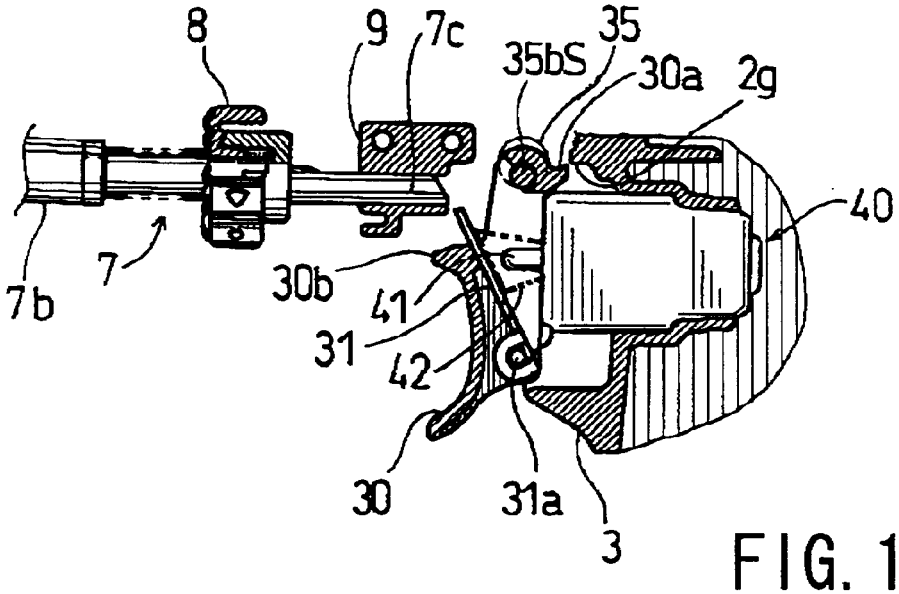
FIG. 12 is a view similar to FIG. 9, but instead, illustrating the operation when the trigger has shifted to an ON position, while the contact arm is held in the lowermost position.

In the state shown in FIG. 9, the stopper protrusion 30*a* of the trigger 30 is displaced leftward (downward as viewed in FIG. 1) from the stopper wall 2*b*. Therefore, as shown in FIG. 12, the trigger 30 can move from the OFF position to the ON position without interfering with the stopper wall 2*b*, even before the upward movement of the contact arm 7. Although the pivot pin 31*a* of the idler 31 may move toward the trigger valve 40, this movement of the idler 31 will not cause substantial retraction of the valve stem 41 into the valve body of the trigger valve 40. Therefore, the trigger valve 40 will not open.

Figure 13:
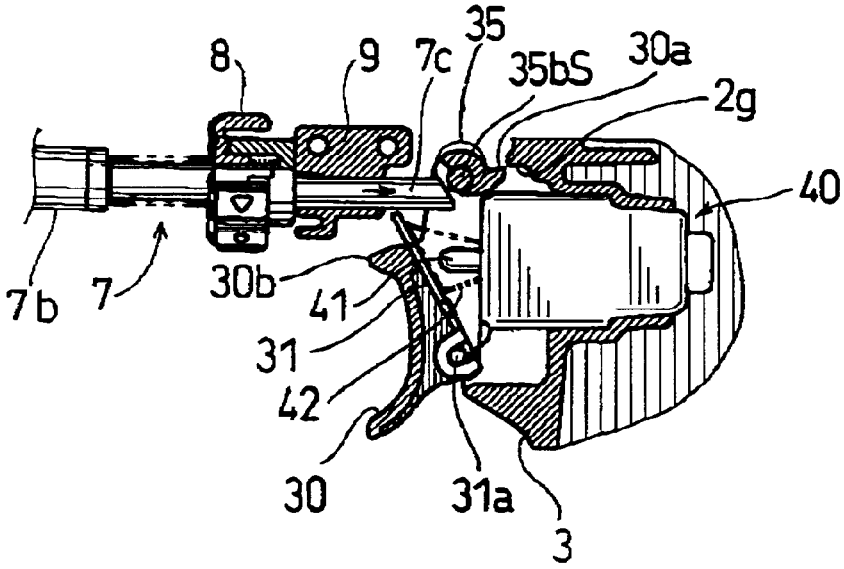
FIG. 13 is a view similar to FIG. 12, but instead, illustrating the operation when the contact arm has raised to the uppermost position.

In addition, as the trigger 30 moves from the OFF position to the ON position, the upper end of the idler 31 opposite to the pivot pin 31*a* may move to a position below a moving path of the operation portion 7*c* of the contact arm 7 as shown in FIG. 12. Therefore, even when the contact arm 7 has moved upward to extend the operation portion 7*c* toward the trigger valve 40, the operation portion 7*c* may not contact the idler 31, but instead, may pass over the upper end of the operation portion 7*c* as shown in FIG. 13. Therefore, the idler 31 cannot move to retract the valve stem 41 into the trigger valve 40.

Therefore, in the limited drive mode, the driving operation of the nails cannot be performed according to the second sequence, in which the contact arm 7 is moved upward after the trigger 30 has been operated. Thus, the driving operation can be made according to only the first sequence.

FIG. 14 shows the nail gun 1 in the drive inhibit mode, in which the small-diameter portion 35 of the support shaft 35 is in the position 35*b*T that is an intermediate position between the positions 35*b*R and 35*b*S in the vertical direction as viewed in FIG. 2 and is displaced from the positions 35*b*R and 35*b*S by the distance L toward the trigger valve 40. In this mode, the stopper protrusion 30*a* of the trigger 30 may be positioned adjacent to and below the stopper wall 2*g*. Therefore, the trigger 30 is prevented by the stopper wall 2*g* from moving from the OFF position to the ON position.

Figure 15:
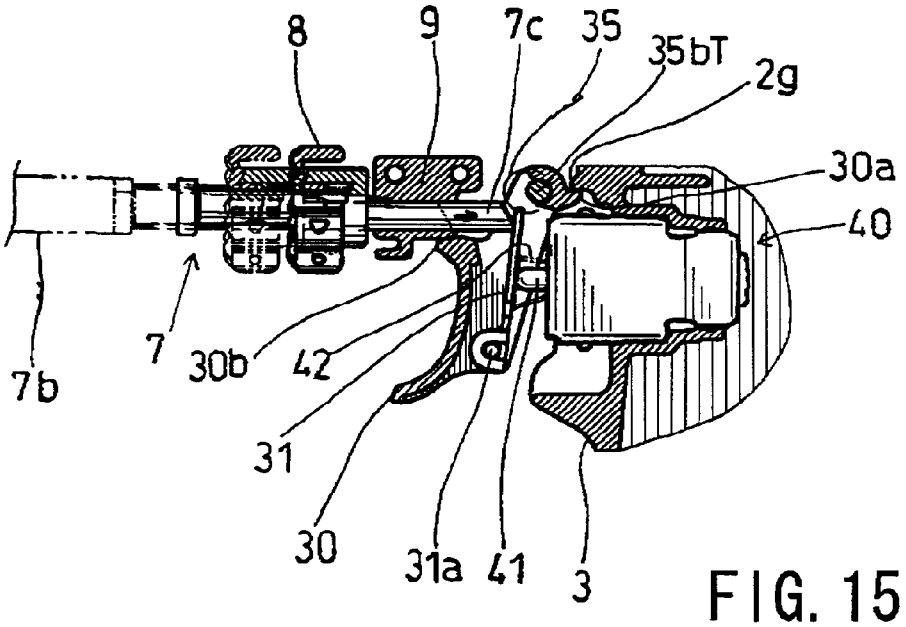
FIG. 15 is a view similar to FIG. 14, but instead, illustrating the operation when the contact arm has raised to the uppermost position.

When the contact arm 7 has moved upward as shown in FIG. 15, the operation portion 7*c* may push the idler 31 to retract the valve stem 41 by a small distance. However, this retracting distance is not sufficient to open the trigger valve 40. As a result, the driving operation of the nail may not be performed.

As described above, according to the representative nail gun 1, the operation mode of the nail gun 1 can be selectively changed among the unlimited drive mode, the limited drive mode and the drive inhibit mode by rotating the support shaft 35 by means of the knob 37. Because the knob 37 or the support shaft 35 is a single member, the mode changing operation can be easily and rapidly performed. Therefore, the representative nail gun 1 has an improved operability.

Also, as described above, in the unlimited drive mode, the driving operation can be performed according to either the first sequence or the second sequence. On the other hand, in the limited drive mode, the driving operation can be performed according to only the first sequence. Thus, in the limited mode, the driving operation can be performed only when the trigger 30 is operated after the contact arm 7 has moved to the uppermost position. Therefore, this mode serves to prevent a nail driving operation, in which the nails are driven by repeatedly reciprocating the contact arm 7, while the operator holds the trigger 30 in the ON position. As a result, an accidental nail-on-nail driving operation can be reliably prevented.

In the drive inhibit mode, the trigger 30 may be prevented from moving from the ON position to the OFF position. In addition, the nails may not be driven even if the contact arm has moved to the uppermost position. Therefore, an accidental driving operation of the nails can be reliably prevented. In particular, with the nail gun 1 set to this mode, the nails will not be driven even if the contact arm has accidentally moved to the uppermost position by contacting the other parts or objects during transportation. Therefore, this representative embodiment is advantageous also in this respect.

In addition, because the drive inhibit mode can be attained by rotating the support shaft 35 that supports the trigger 30, no additional lock pin is required to fix the trigger 30 in the OFF position. Therefore, a trigger lock function can be realized with a simple construction about the trigger 30.

Although in the above representative embodiment, the support shaft 35 is shifted relative to the operation portion 7*c* of the contact arm 7 and the idler 30 in order to change the operation mode, the operation portion 7*c* or the position of the pivot pin 31*a* may be shifted instead of the support shaft 35 to change the operation mode.

For example, a mode change device (not shown) may shift the operation portion 7*c* among three different levels (not shown) in the vertical direction as viewed in FIG. 4. The operation portion 7*c* at an upper level may be positioned above the upper end of the idler 31. In this position, the operation portion 7*c* will not contact the upper portion of the idler 31, even if the contact arm 7 has moved to the uppermost position (rightmost position as viewed in FIG. 4). Therefore, the trigger valve 40 will not open even if the trigger 30 has moved from the OFF position to the ON position. Thus, the drive inhibit mode can be realized. The operation portion 7*c* at an intermediate level may be positioned adjacent to the upper end of the idler 31, so that the idler 31 can be pushed by the operation portion 7*c* only before the trigger 30 has moved from the OFF position to the ON position. As a result, the limited drive mode can be realized. The operation portion 7*c* at a lower level may push the idler 31 irrespective of the position of the trigger 30. Therefore, the unlimited drive mode can be realized.

In the same manner, a mode change device (not shown) may shift the pivot pin 31*a* of the idler 31 among three different levels (not shown) in the vertical direction relative to the trigger 30, so that the unlimited drive mode, the limited drive mode and the drive inhibit mode can be realized. Alternatively, the idler 31 may be modified such that the idler 31 can extend to change the upper end position of the idler 31 at three different positions.

Although the above representative embodiment has been described in connection with the pneumatic nail gun, the present invention can also be applied to the other kind of fastener driving tools such as staplers and screwdrivers.

What is claimed is:

1. A fastener driving tool comprising:

a fastener drive mechanism;

a trigger movable from an OFF position to an ON position for actuating the fastener drive mechanism; and a mode change device operable to selectively change a tool mode among a first drive mode, a second drive mode and a drive inhibit mode for the fastener drive mechanism, the first drive mode being different from the second drive mode;

the mode change device including an operation member that is operable by an operator, the operation member having three operational positions that correspond to the three changeable tool modes.

2. A fastener driving tool as in claim 1, wherein the operation member comprises a single member.

3. A fastener driving tool as in claim 1, further including a control member that cooperates with the trigger for controlling the actuation of the fastener drive mechanism, the control member being movable between a first position and a second position, and wherein:

the first drive mode enables the actuation of the fastener drive mechanism when the trigger and the control member are moved in either a first sequence, in which the trigger is moved from the OFF position to the ON position after the control member has moved from the second position to the first position, or a second sequence, in which the control member is moved from the first position to the second position after the trigger has moved from the OFF position to the ON position; and the second drive mode enables the actuation of the fastener drive mechanism only when the trigger and the control member are moved in either one of the first and second sequences.

4. A fastener driving tool as in claim 3, wherein the second drive mode enables the actuation of the fastener drive mechanism only when the trigger and the control member are moved in the first sequence.

5. A fastener driving tool as in claim 4, wherein the fastener drive mechanism is actuatable in the second drive mode only when the trigger is actuated after actuation of the control member.

6. A fastener driving tool as in claim 3, wherein the control member comprises a contact arm that can move from the second position to the first position upon contact with a workpiece into which fasteners are to be driven.

7. A fastener driving tool as in claim 6, wherein the contact arm comprises an operation portion that cooperates with the trigger for actuation of the fastener drive mechanism, and the mode change device is operable to shift the operation portion in a direction substantially vertically relative to the moving direction of operation portion when the contact arm moves between the first position and the second position.

8. A fastener driving tool as in claim 6 further including an idler that can pivot about a pivotal axis relative to the trigger and serves to cooperate with the contact arm, so that the fastener drive mechanism is actuated by the trigger and the contact arm by means of the idler, and the mode change device is operable to shift the position of the pivotal axis of the idler.

9. A fastener driving tool as in claim 6 further including an idler that can pivot about a pivotal axis relative to the trigger and serves to cooperate with the contact arm, so that the fastener drive mechanism is actuated by the trigger and the contact arm by means of the idler, and the mode change device is operable to change the position of one end of the idler opposite to the pivotal axis.

10. A fastener driving tool as in claim 6 further including a trigger valve that is operable by the trigger and the contact arm in the first and second drive modes for actuation of the fastener drive mechanism.

11. A fastener driving tool as in claim 1, wherein the trigger pivots about a first axis between the ON position and the OFF position, and the mode change device is operable to shift the position of the first axis in response to a change in the tool mode.

12. A fastener driving tool as in claim 11, wherein the mode change device includes a support shaft that is rotatably supported by a tool body about a second axis, the support shaft having a shaft portion, the first axis being defined along the shaft portion, and the first axis and the second axis are displaced from each other.

13. A fastener driving tool as in claim 1, wherein the trigger is prevented from moving from the OFF position to the ON position when the tool is in the drive inhibit mode.

14. A fastener driving tool as in claim 1, wherein the trigger is prevented from moving from the OFF position to the ON position in the drive inhibit mode.

15. A nail gun comprising:

a nail drive mechanism;

a trigger movable from an OFF position to an ON position for actuating the nail drive mechanism;

a mode change device operable to selectively change a tool mode among a first drive mode, a second drive mode and a drive inhibit mode for the nail drive mechanism;

a contact arm serving to cooperate with the trigger for controlling the actuation of the nail drive mechanism, the contact arm being movable between a first position and a second position;

the first drive mode enabling the actuation of the nail drive mechanism when the trigger and the control member are moved in either a first sequence, in which the trigger is moved from the OFF position to the ON position after the contact arm has moved from the second position to the first position, and a second sequence, in which the contact arm is moved from the first position to the second position after the trigger has moved from the OFF position to the ON position;

the second drive mode enabling the actuation of the nail drive mechanism only when the trigger and the control member are moved in the first sequence; and the mode change device including an operation member that is operable by an operator, the operation member having a plurality of operational positions that correspond to the changeable modes.

16. A fastener driving tool comprising:

a fastener drive mechanism;

a trigger pivotable about a first axis from an OFF position to an ON position for actuating the fastener drive mechanism; and a mode change device operable to selectively change a tool mode between a first mode that prevents actuation of the fastener drive mechanism, and a second mode that enables actuation of the fastener drive mechanism;

the mode change device being operable to shift the position of the first axis of the trigger in response to a change between the first mode and the second mode.

17. A fastener driving tool as in claim 16, wherein the mode change device includes a support shaft that is rotatably supported by a tool body about a second axis, the support shaft including a shaft portion, the first axis being defined along the shaft portion, and the first axis and the second axis are displaced from each other.

18. A fastener driving tool as in claim 16, wherein the trigger is prevented from moving from the OFF position to the ON position in the first mode.

19. A fastener driving tool as in claim 18 further including a stopper that is positioned to oppose to the trigger in the first mode, so that the stopper can prevent the trigger from moving from the OFF position to the ON position.

20. An apparatus comprising:

a tool body, means for driving a fastener, the fastener driving means being disposed within the tool body, a trigger coupled to the tool body and movable from an OFF position to an ON position, and means for selecting a tool mode from among an unlimited drive mode, a limited drive mode and a drive inhibit mode, the tool mode selecting means comprising an operation member that is operable by an operator, wherein the operation member has at least three operational positions that respectively correspond to the unlimited drive mode, the limited drive mode and the drive inhibit mode.

21. An apparatus as in claim 20, further comprises a contact arm having a first end and a second end, wherein the first end is arranged and constructed to contact a workpiece into which the fastener will be driven and being movable from a first position to a second position when pressed against the workpiece and wherein the second end is operably coupled to the trigger and the tool mode selecting means.

22. An apparatus as in claim 21, wherein in the limited drive mode the fastener driving means is actuatable only when the contact arm has first moved from the first position to the second position and then the trigger is moved from the OFF position to the ON position.

23. An apparatus as in claim 22, wherein the tool mode selecting means is operable to shift the second end of the contact arm in a direction substantially perpendicular relative to the moving direction of second end when the contact arm moves between the first position and the second position.

24. An apparatus as in claim 22, further including an idler that is pivotable about a pivotal axis relative to the trigger, the idler cooperating with the contact arm, wherein the fastener driving means is actuated by the trigger and the contact arm via the idler and the tool mode selecting means is operable to shift the position of the pivotal axis of the idler.

25. An apparatus as in claim 22, further including an idler that is pivotable about a pivotal axis relative to the trigger, the idler cooperating with the contact arm, wherein the fastener driving means is actuated by the trigger and the contact arm via the idler and the tool mode selecting means is operable to change the position of one end of the idler opposite to the pivotal axis.

26. An apparatus as in claim 22, further including a trigger valve arranged and constructed to be actuated by the trigger and the contact arm in the unlimited and limited drive modes.

27. An apparatus as in claim 20, wherein the trigger is pivotable with respect to the tool body about a first axis between the ON position and the OFF position, and the tool mode selecting means is operable to shift the position of the first axis in response to a change in the tool mode.

28. An apparatus as in claim 27, wherein the tool mode selecting means further includes a support shaft that is rotatably supported by the tool body about a second axis, the support shaft having a shaft portion, the first axis being defined along the shaft portion and the first axis is displaced from the second axis.

29. An apparatus as in claim 20, wherein tool mode selecting means prevents the trigger from moving from the OFF position to the ON position when the drive inhibit mode has been selected.

30. A fastener as in claim 20, wherein the trigger is prevented from moving from the OFF position to the ON position in the drive inhibit mode.

31. An apparatus comprising:

a tool body, means for driving a fastener, the fastener driving means being disposed within the tool body, a fastener guide extending from the tool body, a trigger coupled to the tool body and movable between an OFF position and an ON position, a contact arm movably coupled to the fastener guide and having one end arranged and constructed to contact a workpiece into which the fastener will be driven, wherein the contact arm moves from a first position to a second position when the contact arm is pressed against the workpiece, and a tool mode selector operably coupled to the trigger and the contact arm, the tool mode selector providing an unlimited drive mode, a limited drive mode and a drive inhibit mode, wherein when the limited drive mode is selected, the fastener driving means is actuatable only when the contact arm first has been pressed against the workpiece, thereby moving the contact arm to the second position, and then the trigger is moved to the ON position, and when the limited drive mode is selected, the fastener driving means is not actuatable when the trigger is first moved to the ON position and then the contact arm is moved to the second position.

32. An apparatus as in claim 31, wherein the tool mode selector comprises an operation member that is operable by an operator, wherein the operation member has at least three distinct operational positions that respectively correspond to the unlimited drive mode, the limited drive mode and the drive inhibit mode.

33. An apparatus as in claim 32, wherein the operation member comprises a knob that is rotatable by the operator in order to select the unlimited drive mode, the limited drive mode and the drive inhibit mode.

34. An apparatus as in claim 31, wherein the trigger is pivotably coupled to the tool body via a support shaft and the tool mode selector is operable to shift the position of the support shaft in response to a change in the tool mode.

* * * * *